United States Patent [19]

Itakura

[11] Patent Number: 4,893,855

[45] Date of Patent: Jan. 16, 1990

[54] CATCH UNIT FOR A LATCH DEVICE

[75] Inventor: Ryoichi Itakura, Tokyo

[73] Assignee: Jamco Corporation, Tokyo, Japan

[21] Appl. No.: 267,953

[22] Filed: Nov. 7, 1988

[30] Foreign Application Priority Data

May 27, 1988 [JP] Japan ..... 63-69250[U]

[51] Int. Cl.[4] ..... E05B 15/02

[52] U.S. Cl. ..... 292/341.17; 292/DIG. 65

[58] Field of Search ..... 292/341.14, 341.15, 292/341.17, 66, DIG. 65 X

[56] References Cited

U.S. PATENT DOCUMENTS

| | | | |
|---|---|---|---|
| 333,022 | 12/1885 | Morton | 292/341.17 |
| 2,440,510 | 4/1948 | Hagstrom | 292/341.17 |
| 2,794,665 | 6/1957 | Sasse | 292/341.17 |
| 2,904,367 | 9/1959 | Bennett et al. | 292/341.15 |
| 3,966,248 | 6/1976 | James | 292/DIG. 65 |
| 4,076,294 | 2/1978 | Holmberg | 292/341.17 X |
| 4,181,338 | 1/1980 | Sterling | 292/341.17 |
| 4,595,220 | 6/1986 | Hanchett, Jr. et al. | 292/341.17 |
| 4,626,010 | 12/1986 | Hanchett, Jr. et al. | 292/341.17 X |

*Primary Examiner*—Gary L. Smith
*Assistant Examiner*—Michael J. Milano
*Attorney, Agent, or Firm*—Armstrong, Nikaido Marmelstein, Kubovcik & Murray

[57] ABSTRACT

A catch unit provided on a fixed member of a structure, for use in combination with the latch unit of a latch device attached to a movable member, such as a door or a lid, hinged on the fixed member. The catch unit can be operated from outside to release a latch member in case the latch member is unable to be retracted due to the malfunction of the latch unit. The catch unit comprises a catch body fixed to the fixed member, and a catch member attached to the catch body so as to be moved relative to the catch body. In case the latch member is unable to be retracted in the catch unit due to the malfunction of the latch unit, the catch member is opened from outside to release the latch member from the catch unit.

3 Claims, 7 Drawing Sheets

CATCH UNIT FOR A LATCH DEVICE

BACKGROUND OF THE INVENTION

1. Field of the Invention:

The present invention relates to a catch unit for a latch device for holding a hinged door or a hinged lid for closing an opening, such as a doorway, an emergency exit or an inspection hole, formed in a fixed part of a structure, such as wall or floor of a building and, more specifically, to a catch unit which enables the associated latch member to be released therefrom from outside without breaking the hinged door or the hinged lid so that the hinged door or the hinged lid can be opened when the hinged door or the hinged lid is unable to be opened due to the malfunction of the latch device.

2. Description of the Prior Art:

The hinged door held in place by a latch device is opened by removing hinges pivotally supporting the hinged door when the latch member of the latch device is unable to be disengaged from the catch unit of the latch device due to the malfunction of the latch device. In case of a single swing door which swings through an angle of 180°, piano hinges are used for holding the door. This type of piano hinges are hidden by the door when the door is closed, so that the catch unit of the latch device holding the door in place must be broken with a tool such as an ax or a hatchet to release the latch member of the latch device. However, the work of opening the door or the lid by removing the hinges or the work of opening the door or the lid by breaking the catch unit of the latch device takes much time and needs tools, and both the works are unable to serve the purpose in an emergency.

SUMMARY OF THE INVENTION

Accordingly, it is an object of the present invention to provide a catch unit for a latch device, capable of readily releasing the latch member of an associated latch unit of the latch device from outside the door or the lid without breaking the door or the lid, when the door of a doorway or an emergency exit, or the lid of an inspection hole is caught accidentally due to the malfunction of the latch device.

To achieve the object of the invention, the present invention provides a catch unit for a latch device, attached to a fixed structure to catch the latch member of an associated latch unit, comprising: a catch body with an L-shaped cross section having an opening formed by cutting both the legs thereof meeting each other along the edge thereof to receive the latch member of an associated latch unit of the latch device, and projections projecting respectively from the opposite sides of the opening on the extension of the edge; a base plate fixed at the opposite ends thereof to the legs of the catch body so as to define a predetermined space behind the opening of the catch body; a plate spring fixed to the base plate so as to extend within the space defined by the catch body and the base plate; and a catch door having one side edge pivotally joined to the plate spring with a pivot shaft and the other side edge bent to form a detaining part capable of engaging the projections of the catch body. A part of the opening is closed by the catch door when the detaining part of the catch door engages the projections, and the plate spring urges the pivot shaft constantly so as to bias the pivot shaft away from the projections of the catch body to hold the catch door in a closed state.

In a modification, a catch member partly closing the opening of the catch body has one side edge bent to form the detaining part and the other side edge provided with an opening for receiving a curved portion of the plate spring therein. The detaining part of the catch member engages the projections of the catch body.

In a further modification, a catch member partly closing the opening of the catch body has an attaching part receiving a fastening member therethrough, and a catching part extending substantially perpendicularly to the attaching part and bent at the extremity thereof to form a detaining part which engages the projections of the catch body. The catch member is attached to the catch body with the fastening member and a holding member fixed to the inner surface of the catch body.

DETAILED DESCRIPTION OF THE PREFERRED EMBODIMENTS

First Embodiment (FIGS. 1 to 7)

Figure 1:
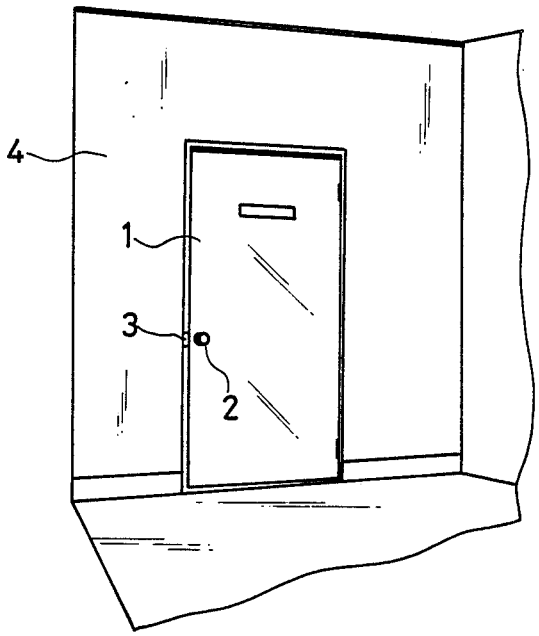
FIG. 1 is a perspective view of a door held in place by a latch device comprising a latch unit and a catch unit.
Figure 2:
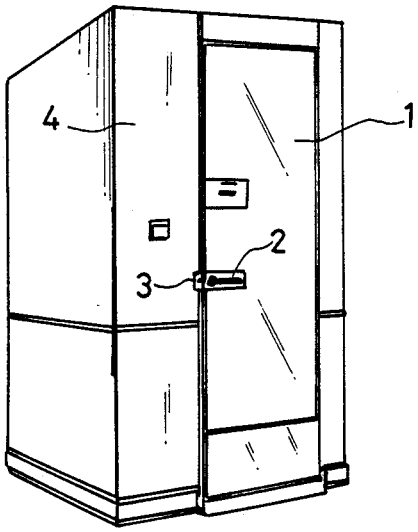
FIG. 2 is a perspective view of another door held in place by a latch device comprising a latch unit and a catch unit.
Figure 3:
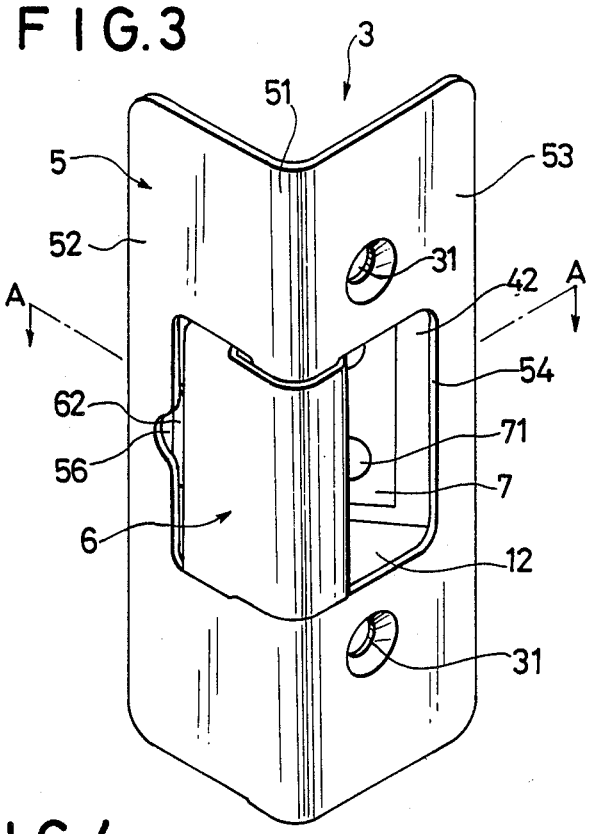
FIG. 3 is a perspective view of a catch unit for a latch device, in a first embodiment, according to the present invention in the normal state of use.
Figure 4:
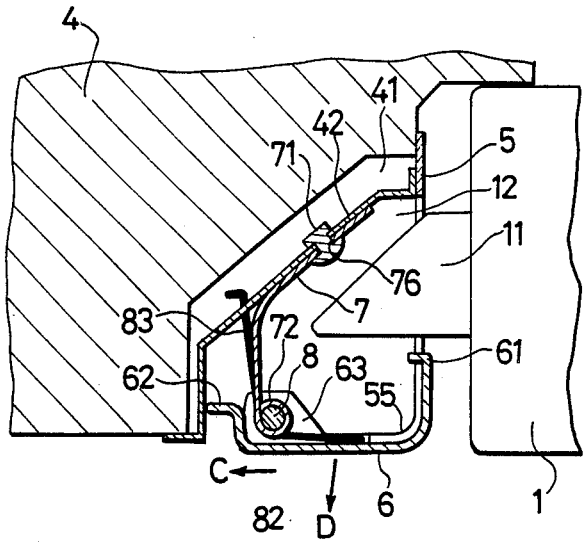
FIG. 4 is a cross-sectional view taken on line A—A in FIG. 3, in which a latch member is received in the catch unit.
Figure 5:
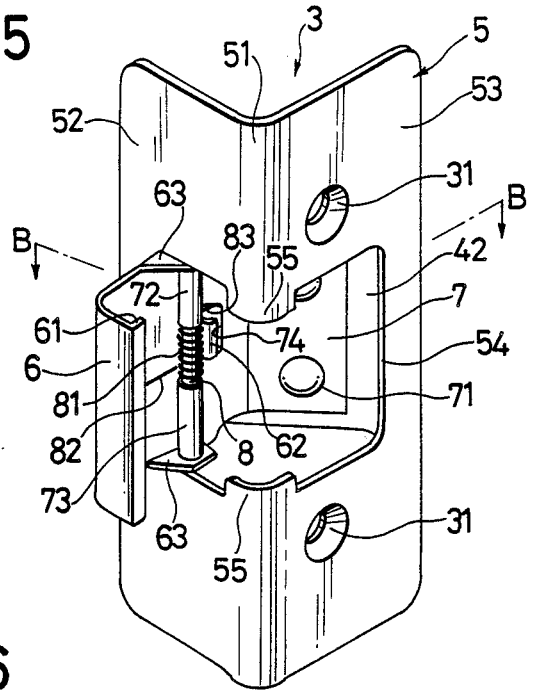
FIG. 5 is a perspective view of the catch unit of FIG. 3, in which a catch door is opened.

Referring to FIGS. 1 and 2, a single swing door 1 is hinged to fixed member 4 of a structure, such as the wall, for swing motion through an angle of 180°. A latch unit 2 is attached to the door 1, while a catch unit 3 is attached to the fixed member 4. The latch unit may be of a knob type as shown in FIG. 1 or of a handle type as shown in FIG. 2. The catch unit 3 is received in a sufficiently large recess 41 formed in the fixed member 4 as best shown in FIG. 4.

The catch unit 3 comprises a catch body 5 formed of an L-shaped metallic plate, a catch door 6, a plate spring 7, and a base plate 42 for supporting the plate spring 7. The catch body 5 is formed by bending a steel plate at an angle corresponding to the angle of the edge of the fixed member 4 in the shape of an angle iron. The front leg 52 and side leg 53, which are substantially the same in size and shape, of the catch body 5 meet each other along an edge 51. A portion of the catch body 5 including part of the edge 51 is cut out to form an opening 54. Respective portions of the upper and lower sides of the opening 54 are projected to form projections 55 on the extension of the edge 51. Bolt holes 31 are formed in the side leg of the catch body 5 above and below the opening 54.

The base plate 42 is formed by bending a plate and is fixed along the opposite longitudinal edges thereof to the respective backsides of the front leg 52 and the side leg 53 to form a suitable space behind the opening 54. The plate spring 7 is fixed to the base plate 42. The opening 54 has a size sufficiently large to receive the latch member 11 of the latch unit 2, and the distance between the respective extremities of the upper and lower projections 55 is large enough to allow the latch member 11 to pass through the space between the extremities of the upper and lower projections 55. Part of the longitudinal side of the opening 54 in the front leg 52 is cut to form a substantially semicircular recess 56 merging into the opening 54.

The catch door 6 with an L-shaped cross section has a base leg covering a portion of the opening 54 of the catch body 5 in the front leg 52 entirely and a slide leg covering a portion of the same in the side leg 53 partly. The edge portion of the slide leg of the catch door 6 is bent to form a detaining part 61, which engages the projections 55 of the catch body 5. Part of the edge of the base leg of the catch door 6 corresponding to the semicircular recess 56 is projected and bent inward to form a lug 62. The upper and lower ends of the edge portion of the base leg of the catch door 6 are bent inward to form hinge pin supports 63.

The plate spring 7 is bent substantially in the middle portion thereof at an obtuse angle. A through hole 76 is formed near one edge of the plate spring 7 to receive a rivet 71 for fastening the plate spring 7 to the base plate 42. The upper and lower portions of the other edge of the plate spring 7 are bent to form an upper knuckle 72 and a lower knuckle 73.

A hinge pin 8 inserted in the upper knuckle 72 and lower knuckle 73 is supported pivotally at the upper and lower ends thereof by the hinge pin supports 63 to join the catch door 6 and the plate spring 7 for relative turning motion. A torsion coil spring 81 is wound round the middle portion of the hinge pin 8 between the upper knuckle 72 and the lower knuckle 73 of the plate spring 7. One end 82 of the torsion coil spring 81 engages the inner surface of the catch door 6 and the other end 83 of the same penetrates through a recess 74 formed in the plate spring 7 between the knuckles 72 and 73 and through a hole formed in the base plate 42 and extends toward the fixed member 4.

Thus, the hinge pin 8 is supported pivotally at the upper and lower ends by the hinge pin supports 63 of the catch door 6, the detaining part 61 and the projections 55 of the catch body 5 are engaged, and screws are inserted through the bolt holes 31 and are screwed in the fixed member 4, such as the wall, to fix the catch body 5 to the fixed member 4. The hinge pin 8 is biased in the direction of the arrow C by the plate spring 7 so that the detaining part 61 engages firmly with the projections 55 of the catch body 5, while the torsion coil spring 81 urges the catch door 6 in the direction of the arrow D, namely, in a clockwise direction as viewed in FIG. 4, about the hinge pin 8.

The function of the catch unit of the latch device in the normal state will be described hereinafter.

When the detaining part 61 of the catch door 6 and the projections of the catch body 5 are held in engagement by the resilience of the plate spring 7, a latch receiving opening 12 for receiving the latch member 11 is formed in a portion of the opening 54 between the side leg 53 of the catch body 5 and the slide leg of the catch door 6. When the door 1 is closed, the latch member 11 drops into the latch receiving opening 12 as shown in FIG. 4 to hold the door 1 closed. In this state, since the hinge pin 8 is urged constantly by the plate spring 7 away from the projections 55 of the catch body 5 and hence the catch door 6 pivotally supported by the hinge pin 8 is urged in the direction of the arrow C, the detaining part 61 of the catch door 6 is in firm engagement with the projections 55 of the catch body 5. Therefore, the hinge door 6 is unable to turn on the hinge pin 8 and is held at the position as shown in FIG. 4.

Figure 6:
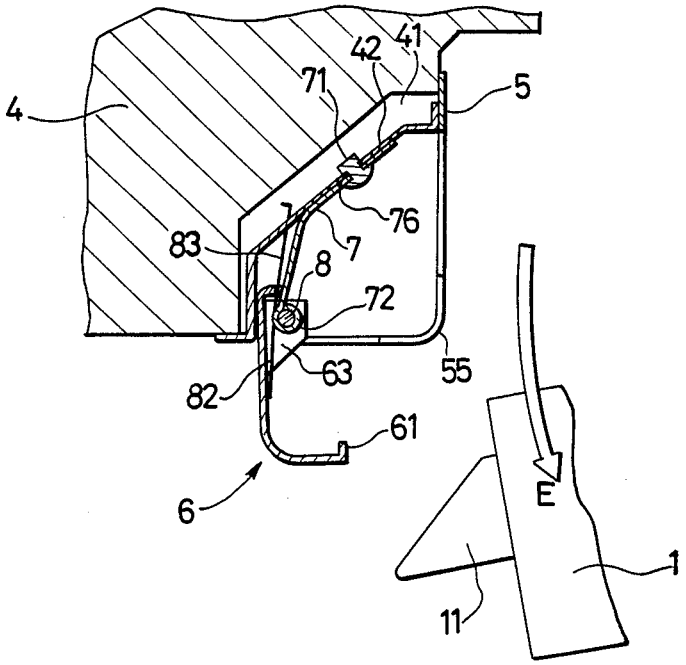
FIG. 6 is a cross-sectional view taken on line B—B in FIG. 5, in which the latch is released.
Figure 7:
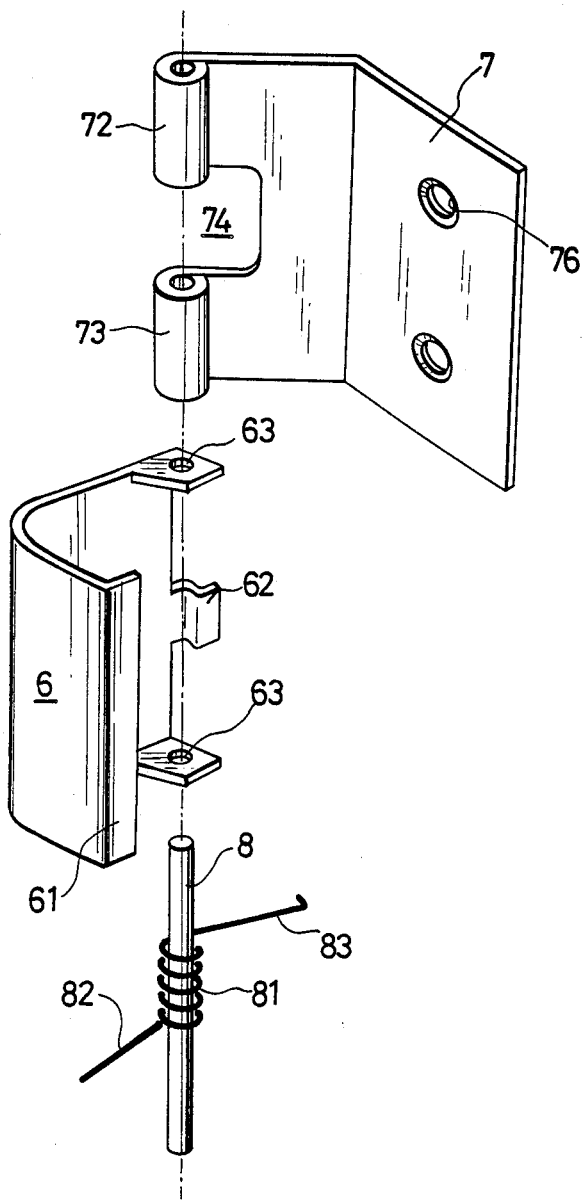
FIG. 7 is an exploded perspective view of assistance in explaining a manner of pivotally joining a hinged door to a plate spring in assembling the catch unit of FIG. 3.

In case the door is locked accidentally due to the malfunction of the latch device, a bar is inserted through the semicircular recess 56 of the catch body 5 into a space behind the base leg of the catch door 6 to push the catch door 6 in a direction opposite the direction of the arrow C in order to disengage the detaining part 61 of the catch door 6 from the projections 55 of the catch body 5. Then, the catch door 6 is turned on the hinge pin 8 in the direction of the arrow D, namely, in a clockwise direction as viewed in FIG. 4, by the torsion coil spring 81 to a position shown in FIGS. 5 and 6. Consequently, the latch member 11 is released from the catch unit 3, so that the door 1 is able to turn in the direction of the arrow E as shown in FIG. 6.

Second Embodiment (FIGS. 8 to 11)

A catch unit 100 in the second embodiment employs a detachable catch member 120 instead of the catch door 6 employed in the first embodiment.

The catch unit 100 has a catch body 101 with an L-shaped cross section formed by bending a metallic plate. The catch body 101 has a front leg and a side leg meeting each other along an edge. An opening 105 for receiving a latch member 11 is formed in the front and side legs of the catch body 101. A portion of the opening 105 in the side leg of the catch body 101 is expanded longitudinally to form upper and lower shoulders 108 on the extension of the edge of the catch body 101. Bolt holes 102 are formed in the side leg of the catch body 101 to receive screws therethrough to fasten the catch body 101 to a fixed member. A base plate 104 is fixed to the backside of the catch body 101 through suitable means such as welding to form a space for receiving the latch member 11 therein. A plate spring 110 is fixed to the base plate 104 with a rivet 106. The free end of the plate spring 110 projects outside from the front leg of the catch body 101, and the edge portion of the free end of the same is bent to form a knuckle 112.

Figure 11:
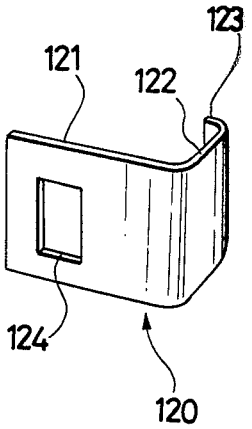
FIG.11 is a perspective view of a catch member incorporated into the catch unit of FIG. 8.
Figure 12:
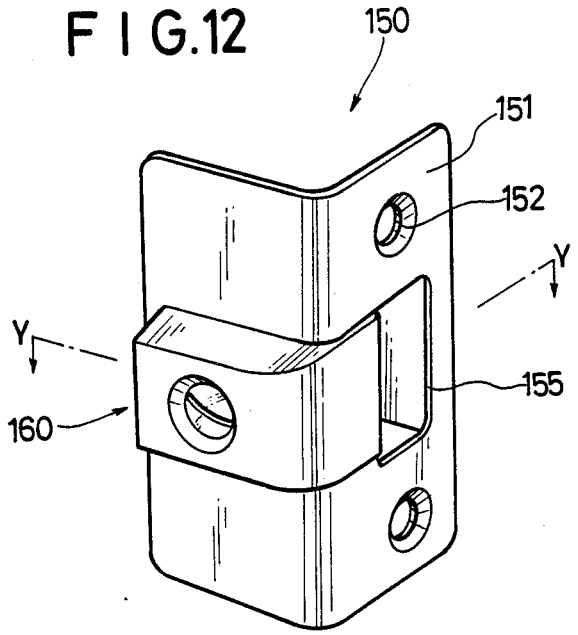
FIG. 12 is a perspective view of a catch unit, in a third embodiment, according to the present invention.

As shown in FIG.11, the catch member 120 formed by bending a metallic plate has a base leg 121, a slide leg 122, and a detaining part 123 formed by bending the edge portion of the slide leg 122. A rectangular opening 124 is formed in the base leg 121.

The detaining part 123 of the catch member 120 is engaged with the shoulders 108 of the catch body 101, and the free end of the plate spring 110 is received through the rectangular opening 124 so that the neck of the knuckle 112 engages the outer side edge of the rectangular opening 124. Thus, the catch member 120 is held firmly on the catch body 101 by the resilience of the plate spring 110. Accordingly, the latch member 11 of a latch unit attached to the door 1 is in engagement with the catch member 120 when the door 1 is closed as shown in FIG. 9.

Figure 8:
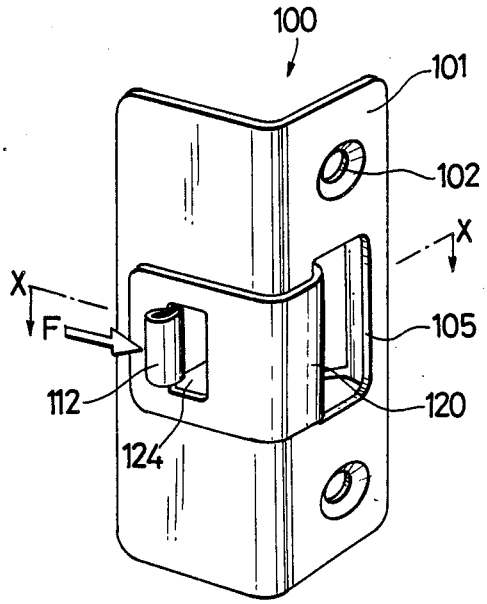
FIG. 8 is a perspective view of a catch unit, in a second embodiment, according to the present invention.
Figure 9:
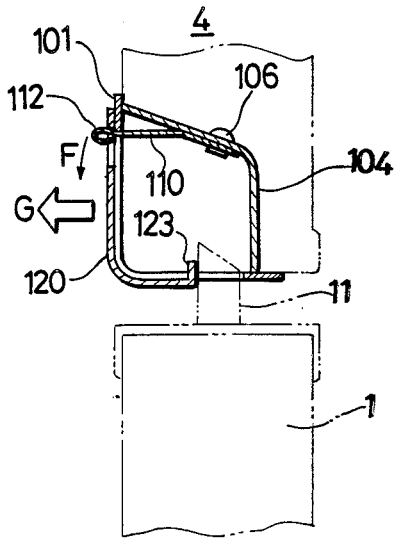
FIG. 9 is a cross-sectional view taken on line X—X in FIG. 8.
Figure 10:
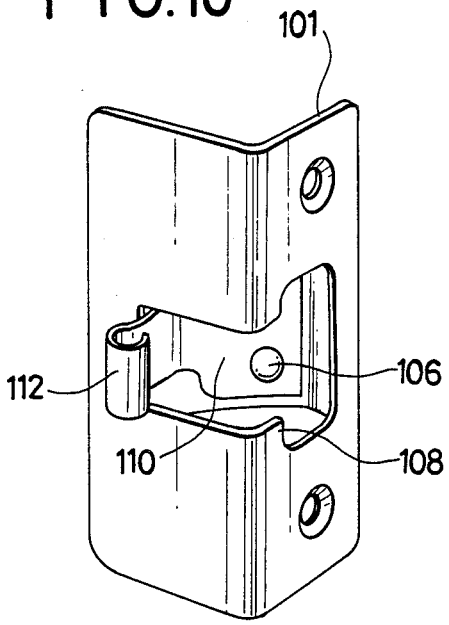
FIG. 10 is a perspective view of the catch unit of FIG. 8, in which a catch member is removed.

In case the latch member 11 is unable to be retracted due to the malfunction of the latch unit, the catch member 120 is pulled in the direction of the arrow G pushing the knuckle 112 of the plate spring 110 in the direction of the arrow F as shown in FIGS. 8 and 9, thereby the catch member 120 is separated from the catch body 101. Consequently, the latch member 11 is able to pass between the shoulders 108 of the catch body 101, so that the door 1 can be opened without retracting the latch member 11.

The catch unit 100 in the second embodiment is advantageous in that the catch unit 100 can be constructed by a comparatively small number of parts, can be manufactured at a comparatively low cost, and is simple in construction.

Third Embodiment (FIGS. 12 to 17)

A catch unit 150, in a third embodiment, according to the present invention has a catch body 151 with an L-shaped cross section formed by bending a metallic plate. The catch body 151 has a front leg and a side leg meeting each other along an edge and is provided with an opening 155 formed in the front and side legs to receive a latch member 11, and bolt holes 152 formed in the side leg above and below the opening 155, respectively, to receive screws therethrough to fasten the catch body 151 to a fixed member. A portion of the opening 155 in the side leg of the catch body 151 is expanded longitudinally to form upper and lower shoulders 158 on the extension of the edge of the catch body 151. A base plate 154 is fixed to the backside of the catch body 151 through suitable means such as welding to form a space for receiving the latch member 11 of the latch unit attached to a door 1.

Figure 15:
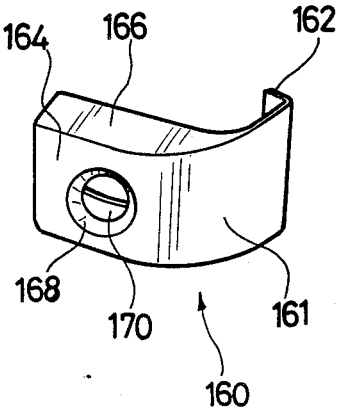
FIG. 15 is a perspective view of a catch member incorporated into the catch unit of FIG. 12.
Figure 16:
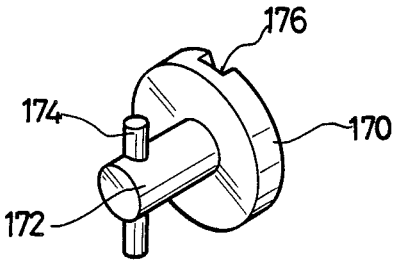
FIG. 16 is a perspective view of a fastening member.
Figure 17:
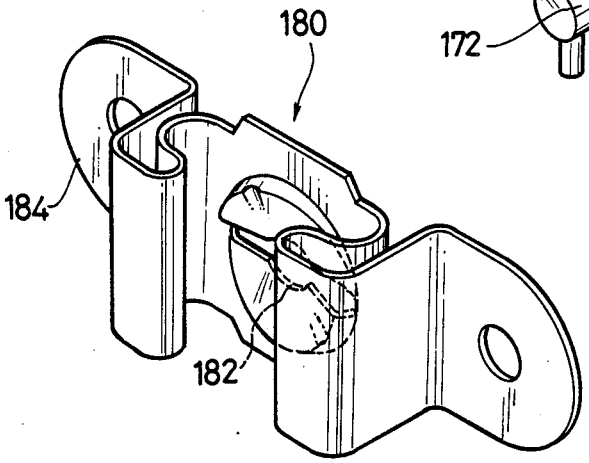
FIG. 17 is a perspective view of a locking member for lockiing the fastening member of FIG.16 in place.

As shown in FIG. 15, a catch member 160 employed in the third embodiment has a base leg 164, a slide leg 161 extending substantially perpendicularly to the base leg 164, and a detaining part 162 formed by bending the edge portion of the slide leg 161. The upper and lower edge portions of the base leg 164 are bent inward to form upper and lower walls 166. An opening 168 is formed in the base leg 164 to receive a fastening member 170 therethrough. The fastening member 170 has a head provided with a groove 176, a stem 172 projecting from the head, and a pair of projections 174 radially projecting from the free end of the stem 172.

An opening 156 for receiving the stem 172 and the projections 174 of the fastening member 170 therethrough is formed in the catch body 151. A locking member 180 is attached to the inner surface of the front leg of the catch body 151 behind the opening 156. The locking member 180 has legs 184 and a locking cam 182. The locking member 180 is fastened by the legs 184 to the catch body 151 by suitable means such as screws. The cam 182 has cam grooves which engage with the projections 174 of the fastening member 170, respectively, and pull in the fastening member 170 as the fastening member 170 is turned.

Figure 13:
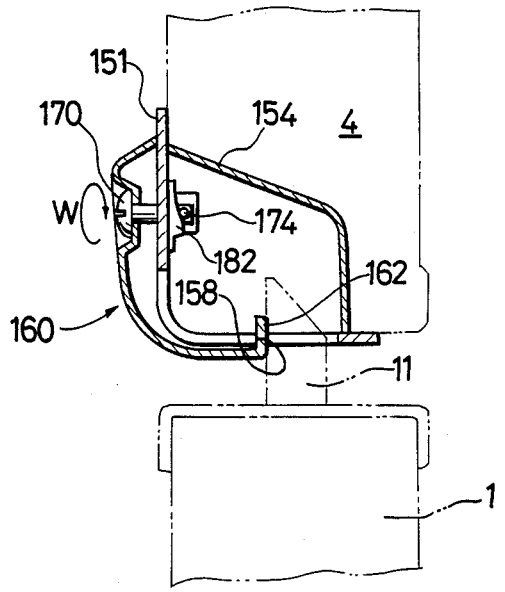
FIG. 13 is a cross-sectional view taken on line Y—Y in FIG. 12.
Figure 14:
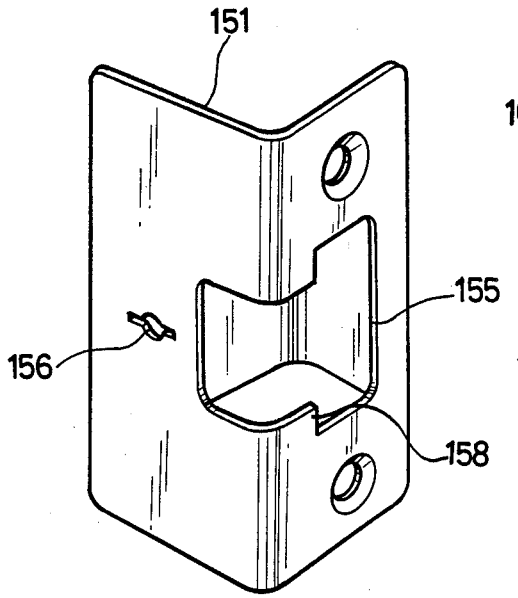
FIG. 14 is a perspective view of a catch body incorporated into the catch unit of FIG. 12.

In attaching the catch member 160 to the catch body 151, the catch member 160 is placed on the front leg of the catch body 151 with the detaining part 162 thereof in engagement with the shoulders 158, the fastening member 170 is inserted through the opening 156 in the cam 182 of the locking member 180 so that the projections 174 engage the cam grooves as shown in FIG. 13, and then the fastening member 170 is turned in the direction of the arrow W, so that the catch member 160 is pressed firmly to the catch body 151.

In case the latch member 11 is unable to be retracted due to the malfunction of the latch unit, the fastening member 170 is turned in a direction opposite the direction of the arrow W with a screw driver or the like to disengage the projections 174 from the cam 182, and then the fastening member 170 is removed from the catch member 160. Then the detaining part 162 of the catch member 160 is disengaged from the shoulders 158 of the catch body 151, and then the catch member 160 is removed from the catch body 151 to enable the door 1 to be opened without retracting the latch member 11.

The fastening device for fastening the catch member 160 to the catch body 151 may be a CAMLOCK FASTENER (Trade Mark) available in the market. When the projections 174 are provided on the stem 172 of the fastening member 170 after passing the stem 172 through the hole 168 of the catch member 160, the fastening member 170 is unseparable from the catch member 160, and hence the fastening member 170 will not be lost when the catch member 160 is removed from the catch body 151.

In the first embodiment, the opening for receiving the latch member can easily be formed by providing the catch body with the opening and the projections projecting from the uppe and lower sides of the opening into the opening on the extension of the edge of the catch body and by engaging the detaining part of the catch door with the projections of the catch body. Since the hinge pin supporting the catch door is urged constantly in a direction away from the projections of the catch body by the resilience of the plate spring so that the detaining part of the catch door is engaged firmly with the projections of the catch body. Therefore, the catch door is never removed accidentally from the catch body even if a large force is exerted on the catch door by the latch member. In case the latch member needs to be disengaged from the catch unit to open the door when the latch member is locked due to the malfunction of the latch unit or when the door needs to be opened from outside in an emergency, the catch door is shifted slightly against the resilience of the plate spring toward the projections to disengage the detaining part of the catch door from the projections of the catch body, and then the catch door is turned outside on the hinge pin. Consequently, the door can be opened with the latch member projecting therefrom.

In the second and third embodiments, the catch member corresponding to the catch door employed in the first embodiment can simply be fastened to the catch body by the engagement of the knuckle of the plate spring with the catch member or by means of the fastening device. Such an arrangement for fastening the catch member to the catch body requires a comparatively small number of parts, is simple in construction, reduces the manufacturing cost, and facilitates the operation of the catch unit.

As apparent from the foregoing description, the latch member of a latch unit provided on a door or a lid can be released from the catch unit without destructing the door or the lid in case the latch member is unable to be retracted due to the malfunction of the latch unit, so that the latch member can be released from the catch unit in a short time in an emergency through a simple operation. Furthermore, the catch door and the catch member can be fastened again to the corresponding catch bodies after releasing the latch member to use the catch unit for the normal purpose, so that the catch unit can repeatedly be operated to release and hold the latch member, which is economical in cost performance.

What is claimed is:

1. A catch unit for a latch device, comprising:

a catch body formed by bending a metallic plate in an L-shaped cross section, having a front leg and a side leg meeting each other along an edge, and provided with an opening for receiving a latch member therein, and upper and lower projections projecting respectively from the upper and lower sides of the opening on the extension of the edge;

a base plate attached along the opposite side edges to the backside of the catch body so as to form a predetermined space behind the opening of the catch body;

a plate spring provided within the space and fixed to the base plate; and a catch door having one end pivotally joined to the plate spring with a hinge pin, and the other end provided with a detaining part which engages the projections of the catch body;

characterized in that the catch door closes a portion of the opening of the catch body when attached to the catch body with the detaining part thereof in engagement with the projections of the catch body, and the plate spring urges the hinge pin constantly away from the projections of the catch body to hold the catch door closed.

2. A catch unit for a latch device, comprising:

a catch body formed by bending a metallic plate in an L-shaped cross section, having front and side legs meeting each other along an edge, and provided with an opening for receiving a latch member therein, and upper and lower shoulders projecting respectively from the upper and lower sides of the opening on the extension of the edge;

a base plate attached along the opposite side edges to the backside of the catch body so as to form a predetermined space behind the opening of the catch body;

a plate spring provided within the space, fixed at one end thereof to the base plate, and having the other end bent to form a curved end; and a catch member having one end provided with an opening, and the other end bent to form a detaining part;

characterized in that the catch member closes a portion of the opening of the catch body when attached to the catch body with the detaining part thereof in engagement with the projections of the catch body, and with the opening thereof receiving the curved end of the plate spring therethrough.

3. A catch unit for a latch device, comprising:

a catch body formed by bending a metallic plate in an L-shaped cross section, having front and side legs meeting each other along an edge, and provided with an opening for receiving a latch member therein, and upper and lower shoulders projecting respectively from the upper and lower sides of the opening on the extension of the edge;

a base plate attached along the opposite side edges to the backside of the catch body so as to form a predetermined space behind the opening of the catch body;

a catch member having a base leg provided with a through hole, and a slide leg extending substantially perpendicularly to the base leg and provided with a detaining part at the extremity thereof;

and a fastening device consisting of a fastening member having a head provided with a recess for receiving the tip of a tool for turning the fastening member, a stem projecting from the head and a pair of radial projections provided at the extremity of the stem, and a locking member attached to the backside of the catch body behind an opening formed in the catch body to receive the stem therethrough, and having locking means for locking the fastening member in place when the projections of the fastening member is inserted therein and turned;

characterized in that the catch member closes a portion of the opening of the catch body when attached to the catch body with the detaining part in engagement with the shoulders of the catch body and with the base leg fastened to the catch body with the fastening device.

* * * * *